US006937739B2

(12) United States Patent
Lee

(10) Patent No.: US 6,937,739 B2
(45) Date of Patent: Aug. 30, 2005

(54) LOUDSPEAKER SET WITH ELASTIC ADAPTER

(76) Inventor: Ping-Yu Lee, No.8,Alley 1, Lane 20, Daren Rd., Taoyuan City, Taoyuan County (TW)

( * ) Notice: Subject to any disclaimer, the term of this patent is extended or adjusted under 35 U.S.C. 154(b) by 0 days.

(21) Appl. No.: 10/685,461

(22) Filed: Oct. 16, 2003

(65) Prior Publication Data

US 2005/0084125 A1 Apr. 21, 2005

(51) Int. Cl.[7] ..... H04R 25/00
(52) U.S. Cl. ..... 381/388; 381/306; 381/333
(58) Field of Search ..... 381/87, 300, 306, 381/333, 334, 335, 386, 388, 332, 182; 361/681–683, 361/686, 724–727; 312/223.1

(56) References Cited

U.S. PATENT DOCUMENTS 6,721,434 B2 * 4/2004 Polk et al. ..... 381/388

* cited by examiner

*Primary Examiner*—Huyen D. Le
(74) *Attorney, Agent, or Firm*—Troxell Law Office, PLLC

(57) ABSTRACT

A loudspeaker set provided with a elastic adapter comprised of two loudspeaker units to be respectively adapted to both side frames of a LCD monitor is characterized by that an adaptation part being each contained in the casing of each unit of loudspeaker to be adapted to its respective side frame, and both units of loudspeaker being connected to each other by means a elastic device to be respectively adapted to both side frames of the monitor.

2 Claims, 1 Drawing Sheet

LOUDSPEAKER SET WITH ELASTIC ADAPTER

BACKGROUND OF THE INVENTION (a) Field of the Invention

The present invention is related to a loudspeaker, and more particularly, to a loudspeaker set provided with an elastic adapter.

(b) Description of the Prior Art

For the loudspeaker set adapted to an LCD monitor generally available in the market is usually either hooked to both sides of the monitor or placed on desktop. If hooked to both sides of the monitor, the loudspeaker has a limited range of operation, and is adaptable only to a single model of the monitor since dedicated hooks must be made available; if placed on desk top, the loudspeaker can be easily turned over by accidental impact and will compromise the neat general appearance of the loudspeaker set and the monitor.

SUMMARY OF THE INVENTION

The primary purpose of the present invention is to provide a loudspeaker set provided with elastic adapter that provides elastic connection between two units of loudspeaker in proper compression and friction forces to be respectively secured to both side frames of an LCD monitor.

To achieve the purpose, the present invention is comprised of two units of loudspeaker to be respectively adapted to both side panels of an LCD monitor. Wherein, each casing of the loudspeaker contains an adaptation part to be adapted to the respective side frame of the LCD monitor and both units of the loudspeaker are connected to each other with an elastic device to be adapted to both side frames of the LCD monitor.

DETAILED DESCRIPTION OF THE PREFERRED EMBODIMENTS

Figure 1:
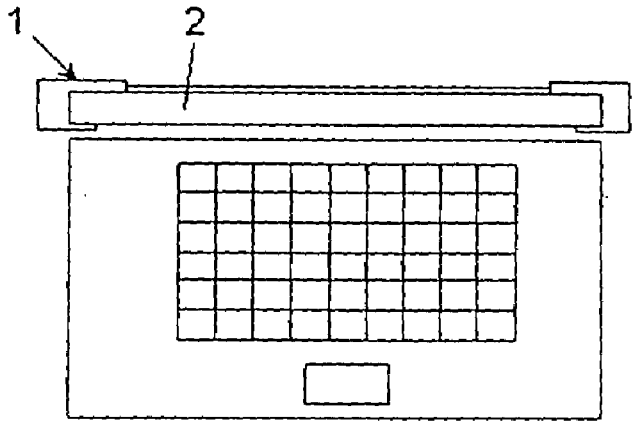
FIG. 1 is a bird's view of a preferred embodiment of the present invention showing that two loudspeakers each provided with an elastic adaptation device are adapted to an LCD monitor of a computer system.
Figure 2:
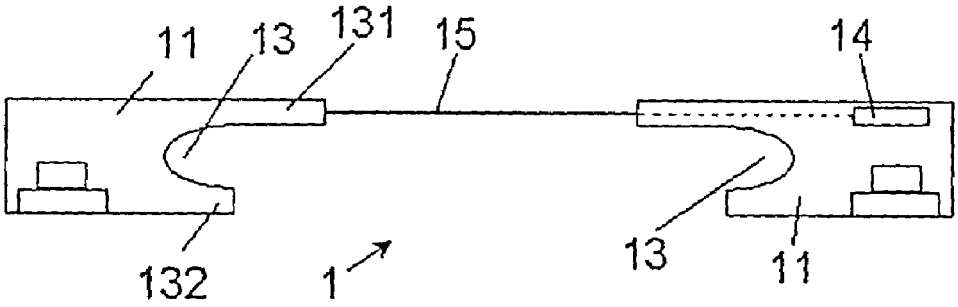
FIG. 2 is another bird's view of the preferred embodiment of the present invention showing the loudspeaker set provided with the elastic adaptation device.
Figure 3:
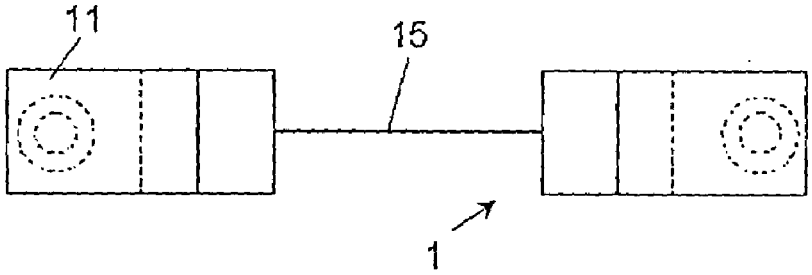
FIG. 3 is a side view of the preferred embodiment of the present invention showing the loudspeaker set provided with the elastic adaptation device.

Referring to FIGS. 1, 2, and 3, a preferred embodiment of the present invention is comprised of a set of loudspeaker comprised of two units of loudspeaker 11 provided with an elastic adaptation device. Wherein, a U-shaped trough 13 is formed on one side of the casing of each loudspeaker 11 so to be adapted to both side frames of an LCD monitor 2. Two feet 131, 132 of the U-shaped trough 13 may be provided in a length different from each other as illustrated in FIG. 2. Each unit of loudspeaker 11 is fixed with a coil spring type wire controller 14, and an elastic member 15 (e.g., a elastic strap). One end of the elastic member 15 winds up inside the wire controller 14 (not illustrated) and the other end fixed to the feet 131 of another unit of loudspeaker 11. A rubber or sponge pad (not illustrated) is provided inside each U-shaped trough 13 to prevent sliding movement produced between the unit of loudspeaker and the side frame and to avoid undesired resonance phenomenon between each unit of loudspeaker 11 and the LCD monitor 2.

In use, both units of loudspeaker 11 must be separated from each other for a certain distance and clicked to both side frames of the LCD monitor 2 as illustrated in FIG. 1. Both of the wire controller 14 and the elastic member 15 ensures that each unit of loudspeaker 11 is adapted to its respective side frame of the LCD monitor 2 with a proper pressure.

The preferred embodiment described above of the present invention does not in any way limit the scope of the present invention. Any change made by the teaching of the present invention shall be deemed as falling within the scope of the Claims claimed in the present invention. For example, the wire controller 14 may be omitted or a rope without elasticity may be used to substitute the elastic member.

I claim:

1. A loudspeaker set with an elastic adaptation device comprising: two loudspeaker units located on opposing sides of an LCD monitor, each of the two loudspeaker units includes a casing having an adaptation part positioning each of the two loudspeaker units on the LCD monitor and the two loudspeaker units are connected together by an elastic device located therebetween, wherein the elastic device contains a coil spring cable controller and an elastic member; the coil spring cable controller being fixed into a first loudspeaker, a first end of the elastic member winding up in the cable controller and a second end attached to a second loudspeaker.

2. The loudspeaker set with the elastic adaptation device according to claim 1, wherein the elastic device is an elastic strap.

* * * * *